United States Patent [19]

Murray

[11] 3,977,096

[45] Aug. 31, 1976

[54] ATHLETIC SHOE

[76] Inventor: John C. Murray, 89 Bruce Avenue, Yonkers, N.Y. 10705

[22] Filed: Nov. 11, 1975

[21] Appl. No.: 631,166

[52] U.S. Cl. ..... 36/59 R
[51] Int. Cl.[2] ..... A43B 23/28
[58] Field of Search ..... 36/59 R, 67 A, 67 D, 36/134, 62

[56] References Cited

UNITED STATES PATENTS

| | | | |
|---|---|---|---|
| 3,066,425 | 12/1962 | Koley | 36/67 D |
| 3,747,238 | 7/1973 | Jankauskas | 36/61 |

*Primary Examiner*—Patrick D. Lawson
*Attorney, Agent, or Firm*—Stanley J. Yavner

[57] ABSTRACT

An athletic shoe, with attached spike plates, depending from each of which are a plurality of spikes. Each spike plate defines a central opening through which is mounted a cleaning member mounted by a spring or another form of resilient member. The athletic shoe portion beneath each spike plate is recessed for mounting of the resilient member and for enabling the cleaning member to be pressed therein without exposure outside of the athletic shoe to a point below the spike plate.

6 Claims, 6 Drawing Figures

FIG. 1
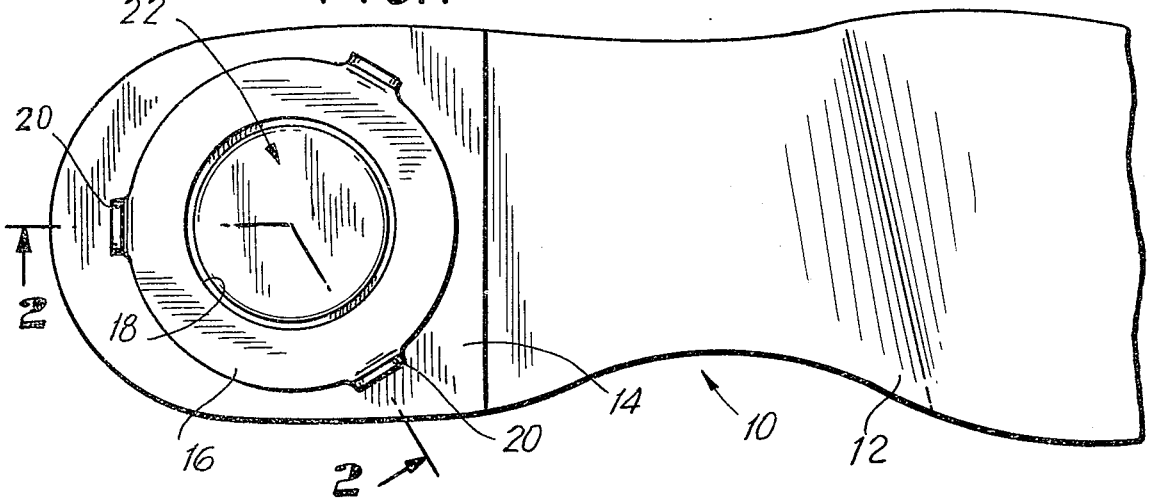
FIG. 2
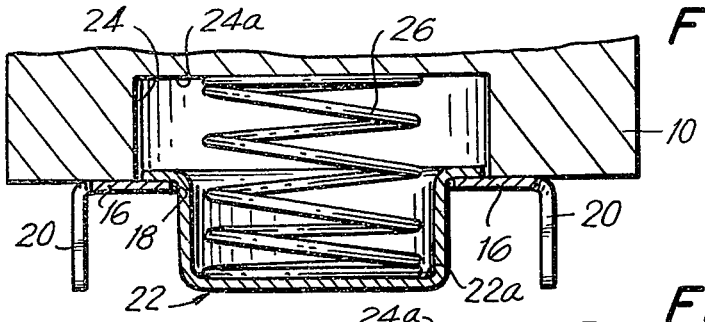
FIG. 3
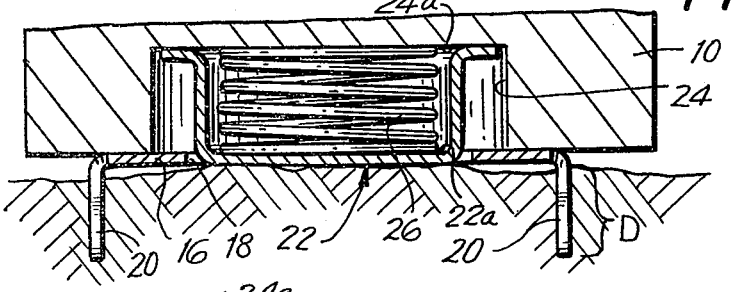
FIG. 5
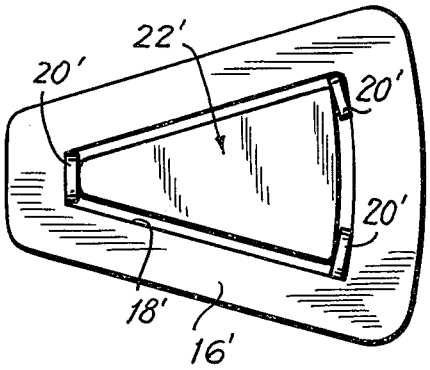
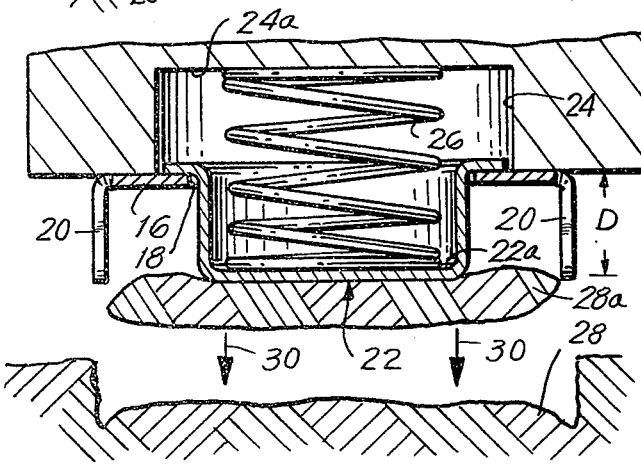
FIG. 4
FIG. 6
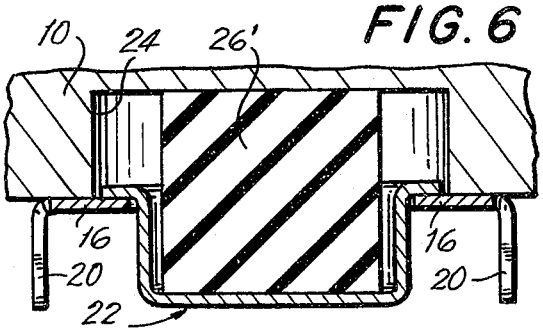

ATHLETIC SHOE

This invention relates primarily to athletic shoes and more particularly to athletic shoes useful in such sports as baseball and track, which require spiked athletic shoes.

For more than 70 or 80 years, baseball, in particular, has been played by the use of equipment particularly suitable for the environment of that sport. For example, athletic shoes useful in the game of baseball have been provided to players of that game in order to prevent slipping of the player as he ran and performed on fields which were either of clay bases or which otherwise featured a muddy or claylike playing surface. The purpose of the spikes, in particular, is to provide a gripping attachment between the player's shoes and the playing surface as he runs. More specifically, baseball spikes are flange-type protrusions downwardly depending from the bottom of the athletic shoe which provide an area against which the player pushes as he takes each stride on the playing surface. The larger the area, the more anti-slipping engagement is provided for the player.

A side effect which has occurred by means of the use of baseball spikes is that mud and clay has a tendency to clog the area between the spikes. This side effect creates essentially the same problem which is solved by the use of spikes; i.e., the mud or clay built up between spikes provides a slipping or anti-friction engagement with the mud or clay on the playing surface. In one sense, this side effect provides even a worse problem in that the player, feeling secure with his spikes, may be lulled into a circumstance which injures him severely when the spikes become clogged and the slipping which was to be prevented by the spikes occurs.

For many of the years in which baseball spikes have been used, others have tried in vain to solve the side effect problem (clogging of the spikes) mentioned above. For instance, others have recommended the use of complex, piston-like structures which depend from the spike plate, to which the spikes are attached. However, such contrivances have never been adopted because, although they provide some assistance for the clogging problem, they, at the same time, reduce the area of the spikes effective in the first instance against the primary slipping problem.

Accordingly, a primary object of the present invention is to provide an athletic shoe to prevent slipping engagement between the shoe and a playing surface.

A further and more specific object of the present invention is to provide a spiked athletic shoe to prevent clogging between the spikes.

A further and still more specific object is to provide a spiked athletic shoe which prevents clogging between spikes, and yet does not reduce the effective contact area between the spikes and the playing surface.

These and other objects of the present invention have been accomplished by an athletic shoe which features one or more spike plates attached to the bottom surface of the shoe and from each of which depends a plurality of spikes. Each spike plate defines a central opening in which a cleaning member is slidably engaged. Beneath each spike plate is a shoe recess into which each cleaning member may be substantially fully inserted. The cleaning members are attached in each recess by means of a spring or another resilient, attaching member such as a nylon or rubber bellows.

The above brief description, as well as further objects, features and advantages of the present invention, will be more fully appreciated by reference to the following, detailed description of the preferred, but nonetheless illustrative, embodiment, when taken in conjunction with the accompanying drawings, wherein:

FIG. 1 is a bottom plan view of part of an athletic shoe constructed according to the present invention;

FIG. 2 is a partial sectional view of the drawing of FIG. 1 and taken along the line 2—2 thereof showing particularly the shoe recess, the resilient, attaching member affixed therein, the slidable cleaning member affixed to the resilient attaching member and the construction generally of the present invention;

FIG. 3 is a sectional view similar to that shown in FIG. 2 but with the cleaning member substantially fully inserted into the shoe recess by means of force from the underlying playing surface, a position assumed as each stride is taken by the wearing player;

FIG. 4 is a partial sectional view of the invention similar to FIG. 2 but with the resilient, attaching member having forced the cleaning member downwardly to clear the spikes of clogged clay or mud;

FIG. 5 is a bottom view of a spike plate useful in an alternative embodiment of the present invention wherein the central opening thereof and the slidable cleaning member thereof are of an enlarged shape conforming more closely to the area defined between spikes; and, FIG. 6 is a partial sectional view similar to that shown in FIG. 2 but with an alternative embodiment for the resilient, attaching member shown.

Referring to the drawings and more particularly to FIGS. 1 and 2 thereof, an athletic shoe, generally designated 10 is shown according to the present invention to include a sole portion 12 and a heel portion 14. Attached to either or both of sole portion 12 and heel portion 14 are spike plates 16 suitably riveted, screwed or otherwise attached. Each spike plate 16 features and defines a central opening 18, the purpose of which will be hereinafter explained. Spikes 20 depend downwardly from spike plates 16 in the manner formerly found in structures according to the prior art. More particularly, spikes 20 are intended for insertion into a clay or mud playing surface (see FIG. 3) whereby a length D of each spike 20 sinks into the mud or clay. Approximately and effectively the greater D is, the more anti-slipping engagement will be provided between a player's shoe and the playing surface.

Also provided in accordance with the present invention is a cleaning member generally designated 22 inserted through central opening 18 and engaged within recess 24 defined by the portion of athletic shoe 10 beneath spike plate 16. Within recess 24 is a resilient, attaching member 26 anchored suitably, such as on the innermost surface 24*a* of recess 24. At the other end, resilient, attaching member 26 is affixed to an inside surface 22*a* of cleaning member 22.

Resilient, attaching member 26 may be of any construction which, after being compressed by an outside force, expands to its original position. For instance, resilient, attaching member 26 is a common spring (FIG. 2) of metal or the like, a resilient rubber or nylon member (FIG. 6) or a combination whereby a metal spring is embedded within a rubber or nylon bellows or the like.

Referring to FIGS. 3 and 4, action of the structure of the present invention is illustrated. As the player strides, his athletic shoe 10 and thereby the structure of the present invention, makes contact with playing surface 28. Spikes 20 sink into the mud or clay of playing surface 28 by an amount represented approximately by the designation D. The face areas of spikes 20 thereby push against the clay or mud to provide traction for the player. Also, the upward contact force of playing surface 28 forces a compression of resilient, attaching member 26 by pushing cleaning member 22 upward into recess 24. Thus, there is no interference between cleaning member 22 and the effective traction-causing area of spikes 20 as represented by D.

As the player lifts his foot for the next stride (FIG. 4), resilient, attaching member 26 expands to its original normal position thereby releasing cleaning member 22 from recess 24. As cleaning member 22 expands outwardly of athletic shoe 10, clogged mud or clay **28*a* is likewise released and the next stride of the player will enable full utilization of the anti-slipping engagement between spikes 20 and the playing surface 28.**

As an alternative embodiment of the present invention (FIG. 5), opening 18' defined by spike plate 16' is of increased surface area with respect to the area between the spikes 20'. Likewise, cleaning member 22' covers more of the potential clogging area between spikes 20'.

Also, a further alternative embodiment is shown in FIG. 6 whereby resilient, attaching member 26' is shown to represent another form such as nylon, rubber or a combination thereof with a metal spring as previously described.

In order to present a more understandable description of the present invention, the following detailed description of the use of the present invention is provided.

An athletic shoe 10, in accordance with the present invention is slipped onto the foot of a player in the usual manner. As the player takes his first stride and thereby makes contact with playing surface 28, spikes 20 are dug into the playing surface by an amount represented by D on the drawing. As spikes 20 move into playing surface 28, the playing surface forces cleaning member 22 into recess 24, and resilient, attaching member 26 compresses. In this way, very little, if any, of cleaning member 22 projects below the plane defined by spike plate 16. The effective length and area D of spikes 20 are thereby enabled fully effective to push against the clay or mud or other composition of playing surface 28 as the player takes his next stride forward. Approximately at the same time athletic shoe 10 is lifted from playing surface 28, as indicated in FIG. 4, any clay or mud or other composition **28*a* tending to clog between spikes 20 will be forced in a direction indicated by arrows 30 in FIG. 4 by means of cleaning member 22 springing downwardly of athletic shoe 10.**

Each successive stride of either foot of the player produces the same action and thus, each stride with athletic shoe 10 will at the same time enable the full anti-slipping effect of spikes 20, prevent clogging between spikes 20 and accomplish both without an adverse effect of one upon the other.

An athletic shoe structure according to the present invention thereby provides accomplishment of the purposes stated herein in an efficient, inexpensive manner.

What is claimed is:

1. An athletic shoe of the type including a bottom portion for attachment of a spike plate, comprising, an attached spike plate defining a central opening, a recess defined by said bottom portion in the area proximate said attached spike plate, a cleaning member slidably inserted to said central opening and insertable to said recess, resilient means affixed to said cleaning member and said athletic shoe in said recess and spikes depending from said spike plate, said cleaning member normally protruding from said bottom portion by an amount approximately equal to the amount by which said spikes depend from said spike plate and said recess extending into said athletic shoe by approximately the same amount.

2. The invention according to claim 1 wherein said resilient, attaching member is in the form of a spring.

3. The invention according to claim 1 wherein said resilient, attaching member is in the form of a bellows.

4. The invention according to claim 1 wherein said cleaning member has an exposed area approximately equal to the area between said spikes.

5. The invention according to claim 1 wherein said spike plate provides a stop for said cleaning member as said cleaning member returns to normal position under the action of said resilient attaching member.

6. The invention according to claim 1 wherein a plurality of said spike plates are attached to said bottom portion.

* * * * *